US005924686A

United States Patent [19]

Jacobson et al.

[11] Patent Number: 5,924,686

[45] Date of Patent: Jul. 20, 1999

[54] METHOD FOR CONTROLLING THE VELOCITY OF SHEET SEPARATION

[75] Inventors: Gary S. Jacobson, Norwalk; Wesley A. Kirschner, Trumbull, both of Conn.

[73] Assignee: Pitney Bowes Inc., Stamford, Conn.

[21] Appl. No.: 08/736,687

[22] Filed: Oct. 25, 1996

[51] Int. Cl.[6] ..... B65H 7/18

[52] U.S. Cl. ..... 271/3.17; 271/4.03; 271/10.03; 271/110; 271/258.01

[58] Field of Search ..... 271/3.17, 4.03, 271/10.03, 110, 258.01

[56] References Cited

U.S. PATENT DOCUMENTS

| | | | |
|---|---|---|---|
| 3,008,709 | 11/1961 | Buslik | 271/10 |
| 3,276,770 | 10/1966 | Griswold | 271/10 |
| 3,583,697 | 6/1971 | Tippy | 271/10 |
| 3,709,596 | 1/1973 | Ulmer | 355/109 |
| 3,948,510 | 4/1976 | Iwamoto et al. | 271/110 |
| 3,970,299 | 7/1976 | Berger, Jr. et al. | 271/250 |
| 3,989,237 | 11/1976 | Goff, Jr. et al. | 271/19 |
| 4,165,870 | 8/1979 | Fallon et al. | 271/10 |
| 4,395,033 | 7/1983 | Janssen et al. | 271/110 |
| 4,398,709 | 8/1983 | Janssen et al. | 271/10 |
| 4,728,966 | 3/1988 | Piatt et al. | 271/110 |
| 4,887,810 | 12/1989 | Grutzmacher et al. | 271/225 |
| 5,034,771 | 7/1991 | Makita | 271/3.17 |
| 5,197,726 | 3/1993 | Nogami | 271/110 |
| 5,201,508 | 4/1993 | Kuo | 271/110 |
| 5,332,207 | 7/1994 | Oonishi et al. | 271/110 |
| 5,580,046 | 12/1996 | Beaufort et al. | 271/10.03 |

FOREIGN PATENT DOCUMENTS

| | | | |
|---|---|---|---|
| 0027852 | 2/1986 | Japan | 271/110 |
| 406016262 | 1/1994 | Japan | 271/110 |

*Primary Examiner*—William E. Terrell
*Assistant Examiner*—Patrick Mackey
*Attorney, Agent, or Firm*—Robert E. Meyer; Melvin J. Scolnick

[57] ABSTRACT

A method for controlling the feeding of sheet material from a sheet feeding device, in which the sheets are stored in a stack and are fed seriatim by a feeding means to a staged position, in which the sheet is partially ejected from the feeding device, and in which the sheet must reach the staged position within total predetermined period of time from the moment that the feeding means is activated. The method comprises the steps of feeding the sheet from a stack to the staged position at a predetermined rate of speed and ascertaining whether the sheet reaches the staged position within intervals of time between each successively higher rate of speed. The operation of the feeding means is terminated when the sheet reaches the staged position within the total predetermined period of time. Further operation of the feeding means is deactivated if the total predetermined period of time expires before the sheet reaches the staged position, deactivation continues until the cause of the failure of the sheet to reach the staged position is ascertained and corrective action is taken.

7 Claims, 2 Drawing Sheets

METHOD FOR CONTROLLING THE VELOCITY OF SHEET SEPARATION

BACKGROUND OF THE INVENTION

This invention relates generally to the field of sheet feeding, and more particularly to a method of controlling the operation of one or more sheet feeders to cause proper separating and of sheets from the one or more feeders so that they are injected into a common feed path in properly timed sequence with other sheets traveling in the common feed path.

The advent of high speed computer printing technology during the past decade or more has led to the development of an abundance of technologically complex related peripheral equipment for processing the output of most computer printers. One such process involves the printing by means of a high speed laser printer of a master document, such as a letter, each of which is individually addressed to a number of different individuals, typically a very large number, such as a thousand or more, in order to justify the cost of the equipment involved in the overall process. At least one, but more typically a plurality of other sheets of material, such as an advertising flyer, information sheet, pictorial material, etc., usually referred to as pre-print sheets, are associated with the letter in an accumulator to form a collation, which in turn is then fed to a folding machine which folds the letter, and the other sheets if need be, to fit into a mailing envelope. The folded collation is fed to an envelope inserting machine where it is inserted into a waiting envelope, which may then be closed, sealed and passed through a mailing machine for ultimate mailing. Although typical material associating processes would involve a plurality of pre-print sheets as just described, the principles of the invention are applicable to the addition of only one pre-print sheet to the letter, and the invention is hereinafter described and claimed to cover this arrangement. Also, it should be understood that the foregoing is only a representative sequence of operations which may be carried out in a particular installation, and one or more of the foregoing steps may be omitted, or other more specialized steps may be added, depending on the requirements of the particular sheet processing installation.

Since the material being assembled and inserted into the envelopes for mailing is addressed to specified individuals, it is very important, as a matter of business policy, to maintain the integrity of the collation by ensuring that it contains the correct number of sheets, and the only way to do that is to count the sheets of paper entering the accumulator where the collation is formed. To do this accurately, it is necessary to have a small gap between the trailing edge of a preceding sheet and the leading edge of a succeeding sheet, so that a suitable sensor can discern the end of one sheet and the beginning of the next, and do so with maximum accuracy while the sheets are traveling at a high rate of speed, in the order of 30 inches per second, which translates into slightly over two sheets per second with a two inch gap between sheets, or 1.17 seconds per sheet. If pre-print sheets are not fed accurately and the gap is eliminated, i.e., either a pre-print sheet is fed too fast and overlaps the trailing edge of a previous laser sheet, or is fed too slowly and overlaps the leading edge of a succeeding laser sheet, then individual sheets entering the accumulator cannot be counted accurately, thereby compromising the integrity of the collation, i.e., the mail piece, that is inserted into an envelope.

In a typical installation, the letters are printed and addressed in a high speed laser printer, which is a synchronous device capable of delivering a sheet every three and one half seconds. If it is desired to insert one or more pre-print sheets with each laser sheet, the pre-print sheet or sheets must be withdrawn from appropriate feeders in which it or they are stored and fed into a common feed path that directs it or them into the feed path leading from the laser printer to the accumulator, and done so with the aforementioned gap between each of the laser sheets and within the time available between delivery of successive sheets from the laser printer. Thus, the feeders for any pre-print sheets must feed these sheets with extreme accuracy and reliability in order to ensure that the pre-print sheets will always enter the feed path of the laser sheets in the precise timed relationship that is necessary for consistently proper accumulation prior to the final collation being folded and inserted into envelopes.

A major problem that exists with virtually all types of commercially available sheet feeders is that the rate of speed at which the primary sheet feeder, i.e., the feeder that separates the top sheet from the stack and feeds it out of the storage device, can feed a single sheet from a stack varies greatly (in terms of milliseconds, occasionally even seconds) depending upon various physical characteristics of the paper involved. For example, such characteristics as paper weight, thickness, static adhesion, surface finish and coefficient of friction, as well as external circumstances such as atmospheric humidity where the process is being carried out, can affect the speed at which paper can be fed from the same feeder. Even paper packaging techniques can have an adverse effect on uniformity of feeding, since in a ream of paper, depending on how it is packaged, it is impossible to guarantee that all adjacent sheets have uniform coefficient of friction. Since it is impossible as a practical matter either to always have the same paper and/or environmental conditions existent all the time, a given primary feeder cannot be relied upon to feed the sheets from the stack with the accuracy required for the application under consideration.

This problem has been partially solved in certain prior art applications by initially feeding a sheet from each pre-print sheet feeder a "staged" position in which the leading edge of the sheet has been engaged by a supplemental feeding device that is external to the storage device in which the stack of pre-sheets is stored. This effectively removes the pre-print sheet from the control of the initial sheet separator and feeder for the purpose of injecting the pre-print sheet into a feed path. The obvious advantage of this is that the accuracy of the supplemental feeding device is not dependent on variations in the aforementioned physical characteristics of the paper, nor variations in atmospheric conditions, with the result that the supplemental feeding device can generally be relied upon to inject a sheet into the common feed path for the laser sheets and the pre-print sheets once the supplemental feeding device is appropriately triggered to commence operation.

A major problem with this arrangement was that the primary feeders could not be relied upon to deliver only a single sheet to the supplemental feeding devices within the short time permitted by the rate of feed of the laser sheets over the range of paper and/or environmental characteristics which could be anticipated in typical applications of the type under consideration. For example, light weight paper with a smooth finish will feed accurately at a high speed, but that speed will produce doubling or tripling with heavier paper having a rough finish. With the primary feeder feeding at a slower speed to accommodate the heavier paper, the sheets may not reach the supplemental feeding device in time. So it becomes necessary to adjust the speed of the primary feeder for a specific type of paper, which prevents the feeding device from operating effectively with mixed paper, or with the same paper but at different times under varying atmospheric conditions. Thus, this solution has not been widely accepted.

Further development attempted to solve this problem by providing algorithms for the primary pre-print sheet feeder which could adjust the speed of operation of the feeder to accommodate differences in the rate of sheet feed dependent upon variations in physical and/or environmental characteristics. These algorithms adapt to paper over a stack, that is, a motor speed for the feeder is initially selected and held constant for a particular sheet. If the sheet is slow to stage, then the motor speed is changed for the subsequent sheet so that it will properly feed the next sheet and desirably all subsequent sheets. However, these algorithms have a number of disadvantages and drawbacks, one of which was that they cannot arrive at a desired motor speed for the subsequent sheets in the stack if there are sheets of different characteristics, because the algorithm is constantly adjusting the motor speed for a subsequent sheet each time it senses a sheet feed of a different speed. These algorithms also imply that the variance of stage times on the first few sheets will be quite high and this can cause problems in systems that have no tolerance. Still further, these algorithms also have a problem with disturbances, i.e., a sudden abnormal change in any normal operating condition, with the result that if, for example, a particular sheet is static charged, it may take longer to stage, and this would cause the controller to adjust incorrectly to subsequent sheets. The end result of these conditions is that there is still a degree of unpredictability about the rate of sheet feed for any given sheet in the stack, which can cause a sheet to stage beyond the period of time normally provided, thereby causing a mis-feed or a non-feed, depending on the nature of the microprocessor, and consequent improper accumulation.

Thus, there is still a need for an improved algorithm for the pre-print sheet feeders which virtually guarantees that the top pre-print sheet of a stack will stage at the proper time in order to ensure proper gap spacing between successive sheets in the flow of sheets to the accumulator, thereby permitting consistently accurate counting of the sheets to ensure the integrity of the final collation, and which also permits sheets of different physical characteristics to be placed in the stack without sacrificing the assurance that they will be staged properly.

SUMMARY OF THE INVENTION

The present invention at least greatly obviates, if not entirely eliminates, the disadvantages and shortcomings of the prior art algorithms utilized in connection with primary pre-print sheet feeders to satisfy the foregoing need.

The algorithm of the present invention is unique in that it is dependent only on the characteristics of the individual sheet being fed from the stack to the staged position. Thus, it allows paper of any type to be placed into a feeder and be staged in a certain period of time, since it uses a combination of varying speeds and timers to guarantee that the sheet will be fed and staged in a certain period of time. The algorithm treats each sheet individually and determines the optimum motor speed for that given sheet. It is independent of hardware and can be programmed for different combinations of motors and sensors. It thus permits sheets of varying characteristics to be placed in the sheet feeding devices without sacrificing the assurance that sheets will be fed singly and will be fully staged within the time permitted depending on the rate at which laser sheets are fed from the laser printer.

In principle, the algorithm of the present invention adapts to each individual sheet of the stack to feed that stack sheet at a speed that is appropriate to accomplish the desired purpose, i.e., properly timed staging, rather than adapting to sheets over the stack to adjust subsequent sheets of the stack. This is accomplished, in the broad sense, by providing the feeder with a variable speed motor that is virtually instantaneously adjustable, relative to the millisecond time frame within which a sheet must be staged, to a higher speed of operation during the feeding of the top sheet, depending upon whether or not that sheet reaches the staged position within a total predetermined period of time from the moment when the primary sheet feeder is activated. This is accomplished by sensing whether or not the sheet is moving from its normal position on the stack to the staged position at a sufficiently rapid velocity to reach the staged position within that time. This in turn is accomplished by ascertaining whether or not the sheet reaches the staged position within intervals of time, which may be known or unknown, as further explained below, but in any event, the sum of which are less than the total predetermined period of time within which the sheet must reach the staged position, and adjusting the speed of operation of the feeder in response to that determination, typically increasing the speed of operation if the sheet does not reach the staged position within a certain number of such successive intervals of time.

Thus, in its broader aspects, the present invention is a method of controlling the feeding of sheet material from a sheet feeding device in which the sheets are stored in a stack and are fed seriatim by a feeding means to a staged position in which the sheet is partially ejected from the feeding device, and in which the sheets must reach the staged position within a total predetermined period of time from the moment that the feeding means is activated. In this environment, the method comprises the steps of activating the feeding means at a first predetermined rate of speed to commence feeding a sheet from the stack. During movement of the sheet, ascertaining whether the sheet reaches the staged position within a first interval of time that is less than the total predetermined period of time, and either deactivating the feeding means if the sheet reaches the staged position within the first interval of time, or increasing the rate of speed of the feeding means to a second predetermined rate of speed if the sheet does not to reach the staged position within the first interval of time. The preceding step is repeated "n" number of times until the sheet either reaches the staged position within the total predetermined period of time or the total predetermined time expires prior to the sheet reaching the staged position. Thereafter, either deactivating the feeding means if the sheet reaches the staged position within the total predetermined period of time, or terminating further operation of the feeding means until the cause for the sheet having failed to reach the staged position within the total predetermined period of time is ascertained and corrective action is taken. Thus, successive sheets are fed from their normal position on the stack to the staged position within the total predetermined period of time regardless of variations in physical and/or environmental conditions which may affect the rate at which the successive sheets can be fed from the stack.

In some of the more limited aspects of the method of the present invention, the repeated steps of increasing the rate of speed of the feeding means if the lead edge of the sheet does not reach the staged position within successive intervals of time also includes the steps of ascertaining whether there is sufficient time remaining within the total predetermined period of time to move the sheet to the staged position. Also, the sum of the first and "n" intervals of time equals the total predetermined period of time within which the sheet must reach the staged position.

The intervals of time before successive increases in the rate of speed of the sheet feeding means may either be predetermined, i.e., fixed in the software of a controlling microprocessor at a specified value. Alternatively, the intervals may be variable in that they are unknown prior to initiation of a cycle of the method and are determined by the occurrence of an outside event that triggers controlling microprocessor to initiate an increase in the rate of speed of the feeding means. The intervals of time may also be variable in the sense that they can be calculated and set in the software based on prior experience with one or more sources of varying operating parameters, such as physical characteristics of paper and operating characteristics of drive motors, drive activating devices and sheet position sensing devices. Finally, the step of terminating further operation of the feeding means if the sheet fails to reach the staged position within the total predetermined period of time includes the step of causing an operator perceivable signal to be initiated indicating this condition.

Having briefly described the general nature of the present invention, it is a principal object thereof to provide an algorithm for ensuring the feeding of sheets from a stack to a staged position within a predetermined period of time.

Another object of the present invention to provide an algorithm for controlling the speed of operation of a sheet feeding device to vary the speed of the feeding device as needed to ensure that the sheet reaches a staged position within a predetermined period of time.

Still another object of the present invention is to provide an algorithm for controlling the speed of operation of a sheet feeding device which is dependent only on the physical characteristics of the individual sheet being fed, so that the feeding device adapts to the characteristics of that sheet to vary the speed at which it is fed to the staged position, thereby permitting sheets of different physical characteristics to be placed in the feeder.

It is still another object of the present invention to provide an algorithm for controlling the speed of operation of a sheet feeding device which adapts to the rate of speed at which each sheet of the stack is moving toward the staged position so as to vary that rate of speed in response to a determination that the sheet will not reach the staged position within a predetermined period of time at the speed at which it is traveling at a given moment.

These and other objects and advantages of the present will become more apparent from an understanding of the following detailed description of the presently preferred mode of carrying out the invention when considered in conjunction with the accompanying drawings.

DETAILED DESCRIPTION OF THE PREFERRED EMBODIMENT

Figure 1:
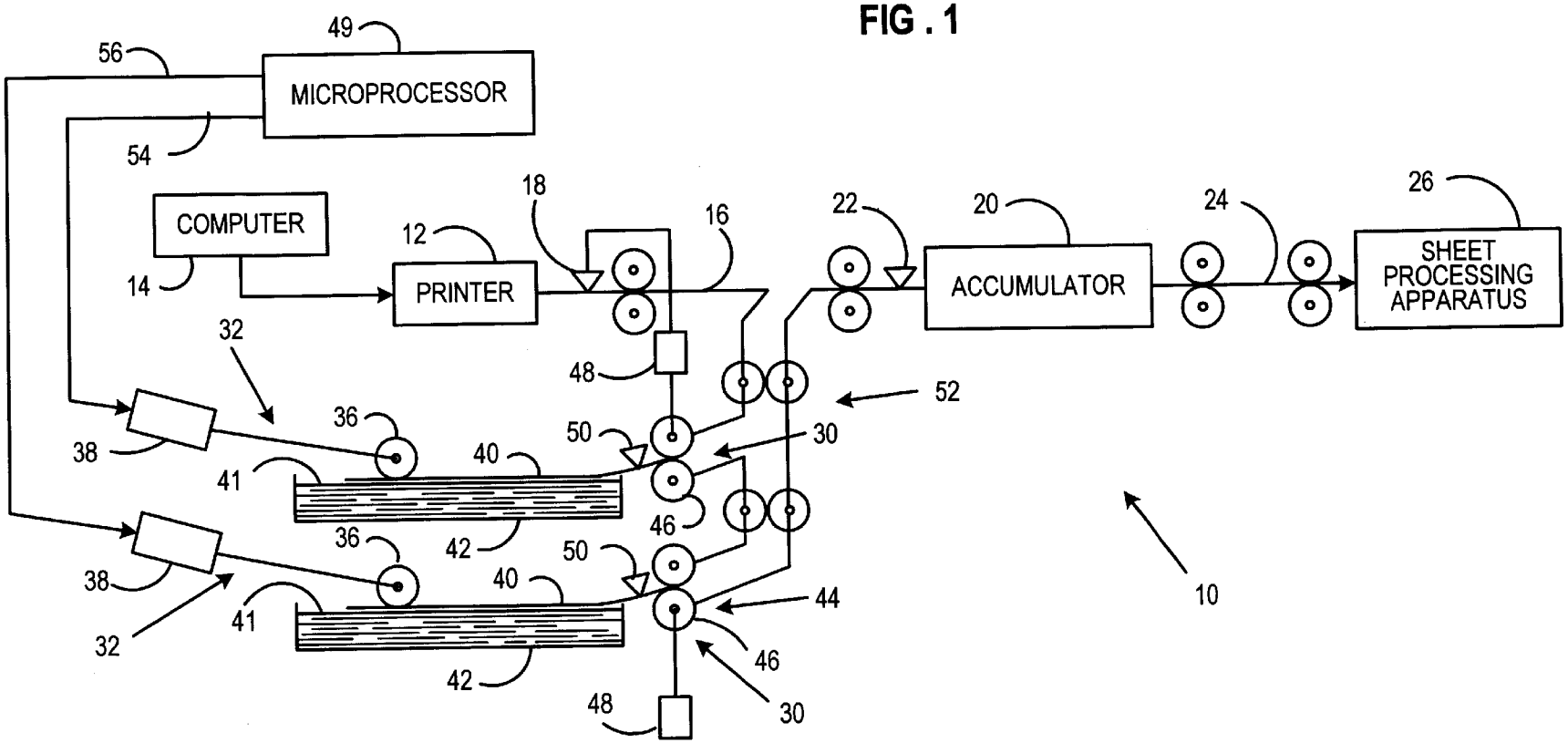
FIG. 1 is a schematic diagram of a typical sheet processing apparatus in which the algorithm of the present invention would be carried out.

Referring now to the drawings, and particularly to FIG. 1 thereof, the reference numeral 10 indicates generally a typical sheet processing apparatus in which the algorithm of the present invention may conveniently be carried out. The apparatus 10 includes a computer printer 12 such as a high speed synchronous laser printer capable of printing a typical page of text in approximately 3.5 seconds. The printer 12 is controlled by a suitable computer 14 which is capable, in known manner, of changing name, address and salutation of each of a succession of letters printed by the printer 12 so that they are personalized to individual addressees. The printer 12 delivers successive letter to a suitable conveyor 16, and a sensor 18, disposed adjacent the output end of the printer 12, senses the arrival of the leading edge of each letters at a predetermined location on the conveyor 16 for a purpose further explained below.

The conveyor 16 is connected to the input end of a suitable accumulator 20 which receives sheets seriatim from the conveyor 16 and arranges the sheets into a properly stacked collation, which forms the ultimate mail piece. The accumulator is provided with a suitable sensor 22, which typically is disposed within the accumulator 20, but is shown outside of the accumulator for the sake of clarity, and which senses the arrival of the leading edge of sheets the accumulator 20, again for a purpose further explained below.

Another conveyor 24 connects the output end of the accumulator 20 to the input end of a further sheet processing component 26 for further processing of the collation formed by the accumulator. Such processing may consist of passing the collation through a collating machine which adds further insert material to the collation already formed, or merely feeding the collation already formed to a folding machine and folding it to a convenient size, or both, after which the collation, with or without further insert material, is delivered to an inserting machine which inserts the collation into an envelope for mailing. These further processing steps form no part of the method of the present invention, and therefore need not be further described.

At least one, but more typically a plurality as shown, of pre-print sheet feeding devices, indicated generally by the reference numeral 30 are disposed in any suitable location in which sheets can be fed from the feeding device 30 into the conveyor 16 along which the laser sheets are fed from the printer 12 to the accumulator 20. Typically, the pre-print sheet feeding devices are located such that sheets from any number of feeding devices can be merged into any suitable form of common conveyor that will feed individual sheets from the feeding devices 30 to the conveyor 16. Thus, in the diagram illustrated in FIG. 1, two such pre-print sheet feeding devices 30 are shown, each having a separating and staging feeder indicated generally by the reference numeral 32. The details of construction of the separating and staging feeders 32 form no part of the present invention and therefore are not further described, other than to note that in each a suitable feeding element 36 is suitably driven by a stepper motor 38 so as to move the top sheet 40 from its normal position on the stack 41 of sheets supported by a suitable supply hopper 42. A take away feeding device, indicated generally by the reference numeral 44 is disposed in spaced relationship with the sheet discharge end of each of the supply hoppers 42, and includes suitable feed rollers 46 driven by motors 48. A pair of sensors 50 are disposed adjacent the feed rollers 46 to sense the arrival of the leading edge of the sheets 40 at the take away feeding devices 44, for a purpose fully explained below. The reference numeral 52 indicates generally any suitable form of sheet conveyor that will serve to transport sheets from each of the take away feeding devices 44 to the conveyor 16.

A microprocessor, indicated generally by the reference numeral 49, controls the operation of the pre-print sheet feeding devices 30 to cause the separating and staging feeders 32 to feed successive top sheets in the hopper or hoppers 42, depending on the number of feeding devices 30 being utilized, from the normal position on the stack 41 to the staged position shown in the drawing within the predetermined amount of time available for this staging movement of the sheets to occur. The microprocessor 49 controls the operation of the stepper motors 38 for each of the separating and staging feeders 32 with respect to both rate of speed and duration of operation at given speeds, as indicated schematically by the lines 54 and 56 for the upper and lower separating and staging feeders 32 respectively, in accordance with software programs in the microprocessor 49. The lead edge sensor 18 controls the operation of the take away feeding devices 44 such that the sheets 40 which have already been staged will arrive at the conveyor 16 in properly timed synchronism with the movement of the laser sheets along the conveyor 16.

Figure 2:
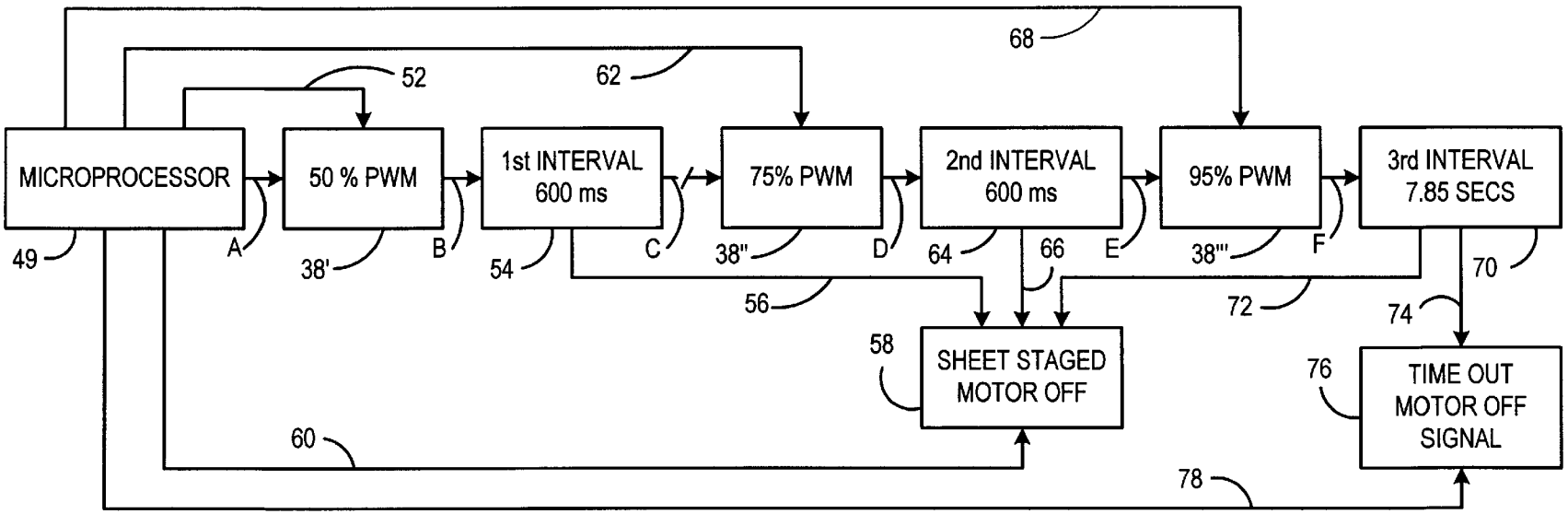
FIG. 2 is a flow chart representing the series of steps performed by the algorithm of the present invention.

To best explain the sequence of the steps involved in the method of the invention, reference is made to FIG. 2, which illustrates in schematic form the sequence of the steps of the method of the present invention with regard to a single pre-print feeding device 30, it being understood that a similar series of steps would be carried out for any number of feeding devices 30 that are provided in the apparatus. The following description assumes that all necessary set up steps to initially stage a top sheet 40 in the feeding device 30 by the separating and staging feeder 32 have been taken to place a top sheet 40 in the staged position with the leading edge thereof in the grasp of the rollers 46. Thus, as soon as the lead edge of a laser sheet from the printer 12 is sensed by the sensor 18, the motor 48 for the feed rollers 46 is energized to feed the already staged sheet 40 into the conveyor 52 to transport it to the conveyor 16 and to the accumulator 20.

It is also necessary, as part of the initial set up procedure, to select a total predetermined period of time within which each sheet must be staged in order for it to be available for feeding by the rollers 46 from the sheet feeding device 30 to the conveyor 16. And it is also necessary, in the preferred embodiment of the invention, where the individual intervals of time are predetermined, to establish the duration of these intervals of time during which the microprocessor 49 will look to see if the sheet has in fact been staged. This is accomplished, as further explained below, by the lead edge sensor 50 which detects the arrival of the lead edge of the sheet 40 at the nip of the feed rollers 48.

It should be understood that the specific values given below for delay periods, motor speeds and percentage of acceleration are merely representative of a particular equipment installation and combination of physical characteristics of paper, and can be varied from one installation to another, or within the same installation to accommodate varying physical characteristics of paper on different runs within the same installation.

Thus, at an appropriate moment after the take away feeder 44 has fully withdrawn the top staged sheet 40 from the hopper 42, the first step in the method, as indicated by the line A connected between the microprocessor 49 and the box 38' is to activate the motor 38 of the separating and staging feeder 32 to operate at a first predetermined rate of speed to commence feeding a sheet 40 from the stack 41. This is accomplished by the microprocessor 49 energizing the motor 38, as indicated by the line 52 also connected between the microprocessor 49 and the box 38', and doing so at a first predetermined rate of speed that is 50% PWM in the illustration given.

The next step, as indicated by the line B connected between the box 38' and the box 54, is to ascertain whether the sheet 40 has reached the staged position by determining whether the lead edge has been detected by the sensor 50, and whether this has occurred with a first predetermined interval of time, which in the case of the preferred embodiment of the method being described is 600 ms. Thus, the microprocessor 49 commences a 600 ms time out interval during which it waits for a signal from the sensor 50 that the lead edge of the sheet has arrived at the nip of the rollers 46.

Thereafter, one of two conditions determines the next step. If the sheet reaches the staged position within this interval of time, the sheet is staged, as indicated by the line 56 connected between the box 54 and the box 58, and the motor 38 is deactivated by the microprocessor 49, as indicated by the line 60, to stop further operation of the feeding element 36. Alternatively, as indicated by the line C (which is shown as broken for a purpose described below) connected between the box 54 and the box 38", if the sheet does not reach the staged position within the designated interval of time, the microprocessor 49 increases the rate of speed of the motor 38 to a second predetermined rate, as indicated by the line 62 connected between the microprocessor 49 and the box 38", which, in the example being described, is 75% PWM.

It should be understood that before the microprocessor 49 increases the rate of speed of the motor 38 to the second predetermined rate of speed, i.e., the 75% PWM level indicated by box 38" in the example given in FIG. 2, the microprocessor will ascertain whether there is sufficient time remaining within the total predetermined period of time for the sheet to reach the staged position at the next higher rate of speed of the motor 38. This is accomplished regardless of whether the intervals of time are known and predetermined or unknown and variable, as explained above. It is only necessary for this step in the algorithm that the total predetermined time for staging be known.

Thus, in the former case, once the microprocessor 49 determines that the leading edge of the sheet 40 did not reach the sensor 50 within the first delay interval of 600 ms, the microprocessor 49, by known software technology, subtracts the 600 ms interval of time already expired from the total predetermined period of time to ascertain whether there is another 600 ms remaining within which the sheet can stage. If so, the microprocessor increases the rate of speed of the motor 38 to the next higher rate, i.e., the 75% PWM. If, on the other hand, the microprocessor 49 ascertains that there is not 600 ms remaining in the total predetermined period of time, it terminates further operation of the motor 38 and, optionally, causes an operator perceivable signal to be initiated indicating this condition, both of these steps occurring in a manner further explained below.

This same step is repeated for each successive delay interval and subsequent increase in the rate of speed of the motor 38.

In the case where the intervals of time are not known, and may vary from situation to situation based on factors described above, the same intervening step as just described still occurs, except that the microprocessor software must deal with a series of unknown intervals, and therefore must calculate whether there is sufficient time remaining in the total predetermined period of time for staging by measuring the time that was required for the outside event to occur, or otherwise calculated as explained above. This interval of time is then substracted from the total predetermined period of time to ascertain whether there is sufficient time for staging at the increased rate of speed within a second interval of time that is based either on the previous interval determined from experience or is calculated based on other conditions.

At this point, it will be apparent from FIG. 2 that the preceding steps of (1) activating the feeding device 32 to move the sheet 40 at a predetermined rate of speed (line 52 and box 38'), (2) ascertaining whether the sheet reaches the staged position within a predetermined interval of time (box 54), and (3) either deactivating the motor 38 to stop the feeding element 36 (line 60 and box 58) if the is staged within the predetermined interval of time, or increasing the rate of speed of the motor 38 (line 62 and box 38") if it is not, can be repeated "n" number of times. This is indicated by FIG. 2 by the broken line C connected between box 38" and box 64, which indicates that the microprocessor 49 can commence another 600 ms time out interval for the same purpose as stated above, and then line 66 connected between box 64 and box 58 to indicate that the sheet reached the staged position within the second predetermined interval of time, or line E connected between box 64 and box 38'", which indicates that the microprocessor 49 again accelerates the motor 38 to a third predetermined rate of speed, as indicated by the line 68 connected between the microprocessor 49 and the box 38'", which in the example given is 95% PWM.

This repetition continues for as many delay intervals and speed increases as are desired, which in the preferred embodiment is the three shown in FIG. 2, to a final predetermined interval as indicated by the line F and the box 70, until the sheet either reaches the staged position within the total predetermined time for staging stored in the microprocessor 49, or the total predetermined period of time expires prior to staging. In the former situation, where the sheet is staged during the third or final predetermined interval of 7.85 seconds in the illustration given, as indicated by the line 72 connected between the box 70 and the box 58, the microprocessor 49 reverts to the procedure described above for staged sheets, and stops the motor 38, as indicated by the line 60 and box 58, to deactivate the feeding element 36, thus terminating one cycle of operation of the feeding device 30. In the latter situation, since the microprocessor 49 knows that the total predetermined period of time has expired, as indicated by the line 74 connected between the box 70 and the box 76 indicating a time out condition, the microprocessor terminates further operation of the feeding device 30, as indicated by the line 78 connected between the microprocessor 49 and the box 76.

In this condition, further operation of the feeding device 38 is prevented until the cause for the sheet having failed to reach the staged position within the total predetermined time stored in the microprocessor is ascertained and appropriate corrective action is taken, typically by the jammed sheet 40 from the hopper 42 and restarting the feeding device 30.

Optionally, when the total predetermined period of time has expired and further operation of the feeding device 30 has been terminated, the microprocessor 49 causes an operator perceivable signal to be initiated indicating that the feeding device 30 has failed to stage the sheet and that a jam has occurred.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. A method of controlling the feeding of sheet material from a sheet feeding device in which the sheets are stored in a stack and are fed seriatim by a feeding means to a staged position in which the sheet is partially ejected from the feeding device, and in which the sheet must reach the staged position within a total predetermined period of time from the moment that the feeding means is activated, said method comprising the steps of:

(a) activating the feeding means at a first predetermined rate of speed to commence feeding a sheet from the stack;

(b) ascertaining whether the sheet reaches the staged position within a first interval of time that is less than the total predetermined period of time, and either (i) deactivating the feeding means if the sheet reaches the staged position within the first interval of time, or (ii) increasing the rate of speed of the feeding means to a second predetermined rate of speed if the sheet does not reach the staged position within the first interval of time, (c) repeating step 1(b) "n" number of times until the sheet either reaches the staged position within the total predetermined period of time or the total predetermined time expires prior to the sheet reaching the staged position, and either (i) deactivating the feeding means if the sheet reaches the staged position within the total predetermined period of time, or (ii) terminating further operation of the feeding means until the cause for the sheet having failed to reach the staged position within the total predetermined period of time is ascertained and corrective action is taken, whereby successive sheets are fed from their normal position on the stack to the staged position within the total predetermined period of time regardless of variations in physical and/or environmental conditions which may affect the rate at which the successive sheets can be fed from the stack;

wherein step 1(c) includes the step of ascertaining whether there is sufficient time remaining within the total predetermined period of time for the sheet to reach the staged position at the next higher rate of speed prior to increasing the rate of speed of the feeding means.

2. The method as set forth in claim 1 wherein the sum of the first and "n" intervals of time equals the total predetermined period of time.

3. The method as set forth in claim 2 wherein the intervals of time are predetermined, the values of which are fixed and reside in the software of a controlling microprocessor.

4. The method as set forth in claim 2 wherein the intervals of time are variable and unknown prior to initiation of a cycle of the method, and are determined by the occurrence of an outside event that triggers the controlling microprocessor to initiate an increase in the rate of speed of the sheet feeding means.

5. The method as set forth in claim 2 wherein the intervals of time are variable and are calculated based on prior experience with sources of varying operating parameters, such as physical characteristics of paper and operating characteristics of drive motors, drive activating devices and sheet position sensing devices.

6. The method as set forth in claim 1 wherein step 1(c) further includes the step of causing an operator perceivable signal to be initiated if the sheet fails to reach the staged position within the total predetermined period of time.

7. A method of controlling the feeding of sheet material from a sheet feeding device in which the sheets are stored in a stack, and are fed seriatim by a feeding means to a staged position in which the sheet is partly ejected from the feeding device, and in which the sheet must reach the staged position within a total predetermined period of time from the moment that the feeding means is activated, said method comprising the steps of:

(a) activating the feeding means at a first predetermined rate of speed to commence feeding of a sheet of the stack;

(b) ascertaining whether the sheet reaches the staged position within a first predetermined interval of time that is less than the total predetermined period of time, and either (i) deactivating the feeding means if the sheet reaches the staged position within the first predetermined interval of time, or (ii) increasing the rate of speed of the feeding means to a second predetermined rate of speed if the sheet does not to reach the staged position within the first predetermined interval of time;

(c) if the feeding of the sheet continues at the increased rate of speed, ascertaining whether the sheet reaches the staged position within a second predetermined interval of time that is less than the total predetermined period of time, and again either (i) deactivating the feeding means if the sheet reaches the staged position within the second predetermined interval of time, or (ii) increasing the rate of speed of the feeding means if the sheet does not reach the staged position within the second predetermined interval of time, (d) if the feeding of the sheet continues at the increased second increased speed, ascertaining whether the sheet reaches the staged position within a third predetermined interval of time that is less than the total predetermined period of time, and either:

(i) deactivating the feeding means if the sheet reaches the staged position within the third predetermined interval of time, or (ii) terminating further operation of the feeding means until the cause for the sheet having failed to reach the staged position within the total predetermined period of time is ascertained and corrective action is taken, whereby successive sheets are fed from their normal position on the stack to the staged position within said total predetermined period of time regardless of variations in physical and/or environmental conditions which may affect the rate at which the successive sheets can be fed from the stack;

wherein the steps of increasing the rate of speed of the feeding means if the sheet does not reach the staged position within the first and second predetermined intervals of time also includes the steps of ascertaining whether there is sufficient time remaining within the total predetermined period of time to move the sheet to the staged position.

* * * * *